US009035211B2

(12) United States Patent
Schiffbauer

(10) Patent No.: US 9,035,211 B2
(45) Date of Patent: May 19, 2015

(54) GAS BLAST INTERRUPTER

(75) Inventor: Daniel C. Schiffbauer, Uniontown, PA (US)

(73) Assignee: Pennsylvania Breaker, LLC, Canonsburg, PA (US)

( * ) Notice: Subject to any disclaimer, the term of this patent is extended or adjusted under 35 U.S.C. 154(b) by 315 days.

(21) Appl. No.: 13/553,914

(22) Filed: Jul. 20, 2012

(65) Prior Publication Data

US 2013/0020285 A1 Jan. 24, 2013

Related U.S. Application Data

(60) Provisional application No. 61/509,727, filed on Jul. 20, 2011.

(51) Int. Cl.
*H01H 33/82* (2006.01)
*H01H 33/80* (2006.01)
*H01H 33/91* (2006.01)

(52) U.S. Cl.
CPC ..... *H01H 33/91* (2013.01); *H01H 33/82* (2013.01)

(58) Field of Classification Search
CPC ..... H01H 33/72; H01H 33/80; H01H 33/82; H01H 33/86
USPC ..... 218/43–47, 61–66, 76
See application file for complete search history.

(56) References Cited

U.S. PATENT DOCUMENTS 3,602,670 A 8/1971 Teijeiro
3,965,947 A 6/1976 Easton et al.
4,206,331 A 6/1980 Kii
4,362,915 A 12/1982 Swindler
4,387,280 A 6/1983 Iman
4,604,508 A * 8/1986 Talpo ..... 218/47
5,150,690 A 9/1992 Carter et al.
6,013,888 A 1/2000 Thuries
6,489,581 B2 12/2002 Ozil et al.
6,696,657 B2 2/2004 Hirose et al.
7,250,583 B2 7/2007 Cameroni et al.
7,339,132 B2 3/2008 Urai et al.
7,566,842 B2 7/2009 Hunger et al.
7,829,814 B2 11/2010 Marchand et al.
8,044,318 B2 * 10/2011 Dufournet et al. ..... 218/46
2007/0241079 A1 10/2007 Johnson et al.
2010/0219161 A1 9/2010 Seeger et al.
2011/0192821 A1 * 8/2011 Dufournet ..... 218/54

FOREIGN PATENT DOCUMENTS

WO WO 2010040574 A1 * 4/2010 ..... H01H 33/90

* cited by examiner

*Primary Examiner* — Amy Cohen Johnson
*Assistant Examiner* — Marina Fishman
(74) *Attorney, Agent, or Firm* — Fox Rothschild LLP

(57) ABSTRACT

A gas-insulated circuit interrupter is disclosed, the interrupter having an improved design for quenching electrical arcs. The interrupter includes a first contact and a second contact configured to alternatively connect to and disconnect from the first contact. One or both of the contacts are at least partially contained in an arcing chamber. The arcing chamber includes the point at which the contacts connect during current-carrying operation of the interrupter. The arcing chamber is at least partially surrounded by a heating chamber for accommodating a quenching gas. A channel connects the heating chamber and the arcing chamber and is positioned to direct the quenching gas toward the first contact and the second contact arcing area. One or more valves direct gas from the arcing chamber to the heating chamber when the interrupter is operated to interrupt a current.

20 Claims, 5 Drawing Sheets

GAS BLAST INTERRUPTER

RELATED APPLICATIONS AND CLAIM OF PRIORITY

This patent document claims priority to U.S. Provisional Patent Application No. 61/509,727, filed Jul. 20, 2011, the disclosure of which is hereby incorporated by reference in its entirety.

BACKGROUND

The present disclosure relates to high-voltage circuit interrupters. More specifically, the present disclosure relates to a high-voltage circuit interrupter having an improved density gas blast for quenching arcs.

A gas-insulated high-voltage circuit interrupter typically contains a male contact, a female contact that is capable of moving relative to the male contact along an axis, a heating chamber for accommodating a supply of quenching gas, and a heating channel positioned to direct the quenching gas toward the contacts. With this type of interrupter, the pressure of the quenching gas within the heating chamber is generating when an arc occurs between the two contacts as the two contacts disconnect. As the contacts disconnect, high pressure gas is forced up the heating channel into the heating chamber. There, the quenching gas already in the heating chamber is pressurized and, after the pressure reaches a high enough level, the quenching gas is forced out of the heating chamber through the heating channel toward the arc as it approaches current zero, thereby extinguishing the arc. The interrupter may also include an insulating nozzle positioned to direct the pressurized quenching gas toward the arc.

In order to quench the arc, a quenching gas such as sulfur hexafluoride ($SF_6$) or a combination of gases is used. The quenching gas is compressed during the disconnecting of the contacts and subsequently extinguishes the arc, thereby interrupting the current flow at a zero crossing.

Interrupters using self-blowing arc quenching, or "inhale/exhale" interrupters, have several disadvantages. Depending upon the geometry and stroke position of the contacts, a larger portion of the energy created by the arc is lost to female-side exhaust rather than pressurizing the quenching gas in the heating chamber. Additionally, the gas forced into the heating chamber or "inhaled" into the heating chamber increases the temperature of the quenching gas already stored in the heating chamber, thereby reducing the density of the quenching gas and the overall associated quenching capabilities as the quenching gas is subsequently "exhaled" toward the arc.

SUMMARY

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this document is to be construed as an admission that the embodiments described in this document are not entitled to antedate such disclosure by virtue of prior invention. As used in this document, the term "comprising" means "including, but not limited to."

In one general respect, the embodiments disclose a gas-insulated circuit interrupter. The interrupter includes a first contact and a second contact configured to alternatively connect to and disconnect from the first contact. One or both of the contacts are at least partially contained in an arcing chamber. The arcing chamber includes the point at which the contacts connect during current-carrying operation of the interrupter. The arcing chamber is at least partially surrounded by a heating chamber for accommodating a quenching gas. A channel connects the heating chamber and the arcing chamber and is positioned to direct the quenching gas toward the first contact and the second contact arcing area. One or more valves direct gas from the arcing chamber to the heating chamber when the interrupter is operated to interrupt a current.

DETAILED DESCRIPTION

Over the years, gas-insulated circuit interrupters have been continuously improved to deliver higher fault duty by extensive testing, analysis and redesign. Fault interruption requirements have progressed from 25 kA to 31.5, 40, 63 and, in some examples, 80 kA. This increase has been primarily driven by increased power demand on electrical grids. When demand increases, it is much less expensive to upgrade existing equipment than it is to install and implement new lines, substations, relays, or other equipment.

As the fault current requirements increased, manufacturers began designing interrupters to include large, expensive capacitors. By using large amounts of capacitance, the manufacturers are limited in the voltage ratings the interrupters can safely handle. Additionally, large scale capacitors are expensive to produce and add another component failure mode.

This document describes a novel interrupter capable of providing robust performance at high fault current levels by taking advantage of some of the lost energy typically found in prior inhale/exhale designed interrupters. In some embodiments, the design described below may help to reduce degradation of the quenching gas—such as sulfur hexafluoride ($SF_6$) without significantly increasing the mechanical energy required to disconnect the interrupter contacts.

Figure 1:
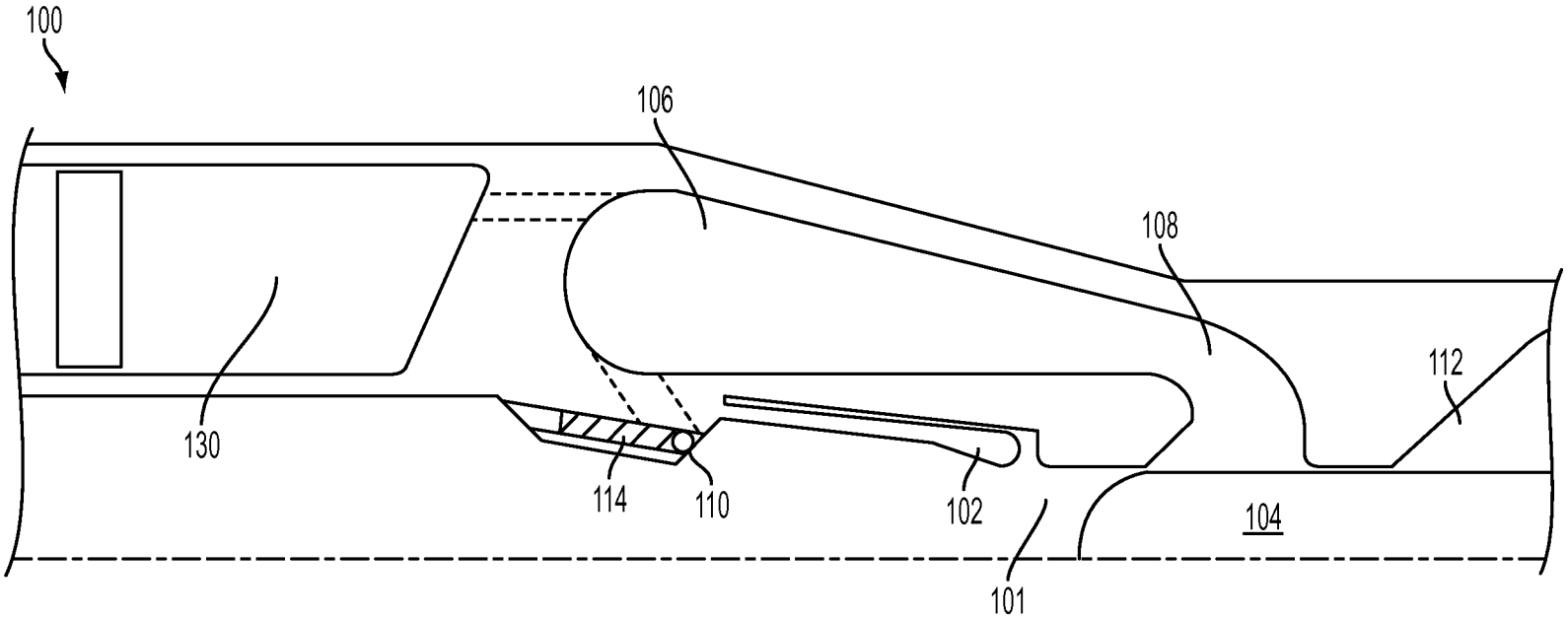
FIG. 1 illustrates an example of a circuit interrupter.

FIG. 1 illustrates an example of an interrupter 100. The interrupter includes an arcing chamber 101 that is surrounded in part by a heating chamber 108. The arcing chamber contains one or more of the currently—carrying contacts 102, 104 through which current flows during non-interrupting operation. In this example, a male contact 104 and a female contact 102 are shown in positions where they have just begun to disconnect. A quantity of quenching gas such as $SF_6$ may be stored in heating chamber 106. The heating chamber may be in fluid connection with the arcing chamber 101 via a fluid delivery connection that is made at or near the location at which the contacts connect during current-carrying operation and arc during interruption. In the embodiment shown, heating chamber may be have a narrower width at the location where it connects to the arcing area and wider width at a base area away from the arcing area. Thus, the chamber includes or is connected to a channel 108 that conveys the quenching gas to the arcing area. The arcing chamber 101 is also fluidly connected to one or more exhausts 110, 112.

It should be noted that the female contact 102 and the male contact 104 are shown by way of example only. In an alternative embodiment, the contacts may have an alternative shape that provides an electrical connection between the contacts when in a connected position. Additionally, one or both of the contacts 102 and 104 may be configured to move during the disconnection operation.

Similarly, the stroke of female contact 102 during the disconnection operation is shown in the figures as a linear path of movement by way of example only. In an alternative embodiment, the stroke of the movable contact or movable contacts may be a radial path of movement or other non-linear paths of movement.

Interrupter 100, as shown in FIG. 1, may include one or more valves 114 positioned in or through a wall that separates the arcing chamber 101 from the thermal chamber 106. Upon movement of the female contact 102, the valves 114 may open or otherwise move such that the pressurized gas passing through the female-side exhaust 110 may be routed into the thermal chamber 106. Specifically, a device or actuator may be connected to the valve 114 and the female contact 102 such that movement of the female contact regulates movement of the valve 114. For example, as the female contact 102 begins its stroke, the valve 114 may be fully open. As the female contact 102 continues its stroke, the valve 114 may shut, fully closing when the female contact reaches the end of its stroke.

Figure 2:
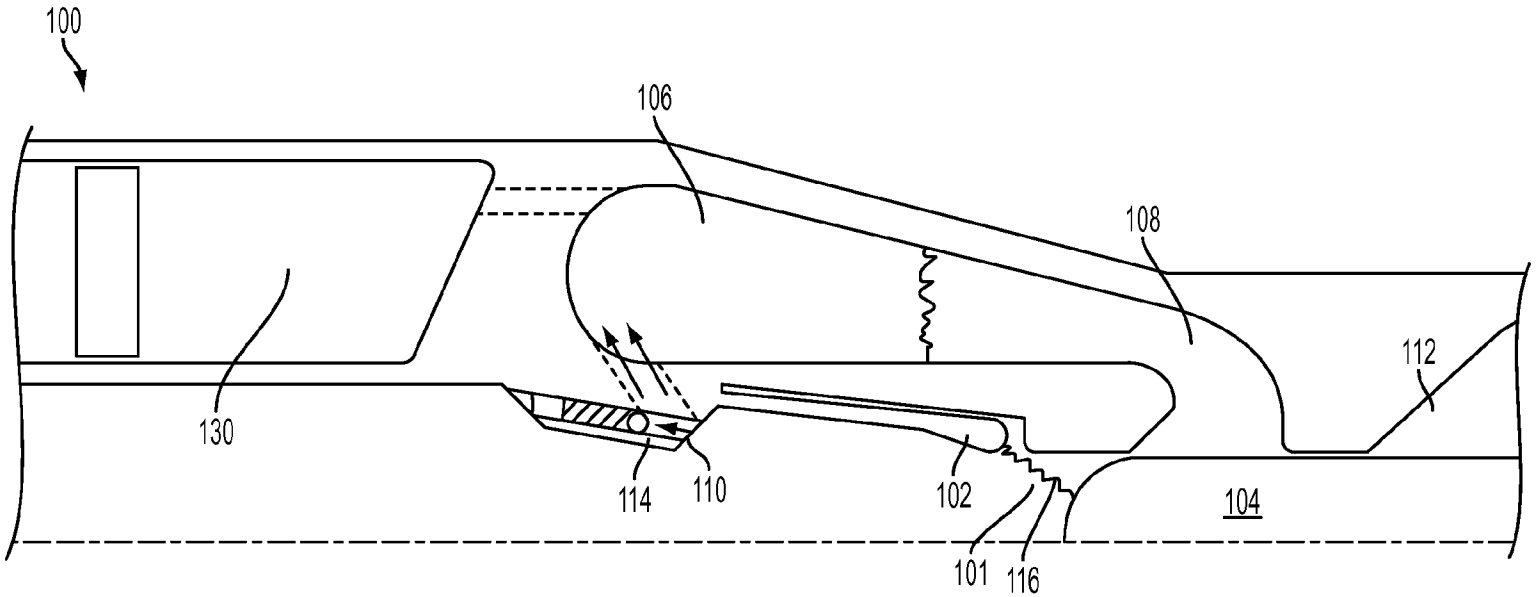
FIG. 2 illustrates the circuit interrupter of FIG. 1 as an arc forms between contacts of the interrupter and valves direct pressurized gas formed by the arc.

As shown in FIG. 2, an arc 116 may occur between the male contact 104 and the female contact 102 as the female contact further disconnects from the male contact. As the arc 116 burns, the gas in the immediate vicinity of the arc will increase in temperature and, as a result of the increasing temperature, expand, thereby pressurizing the gas around the burning arc. As the pressurized gas travels through the female-side exhaust 110, the valves 114 may redirect the gas flow into the heating chamber 106, thus pressurizing the quenching gas contained within the heating chamber. As the pressurized gas (represented by the arrows in FIG. 2) enters the heating chamber 106, the quenching gas contained within the heating chamber 106 may be compressed through a piston like action as opposed to the gas mixing as is common in the prior art. As such, the temperature and density of the quenching gas contained within the heating chamber 106 is relatively unchanged, thereby maintaining a higher level of quenching potential in the quenching gas. As the quenching gas within the heating chamber 106 is compressed, the quenching gas is forced through the channel 108 to extinguish the arc 116.

Figure 3:
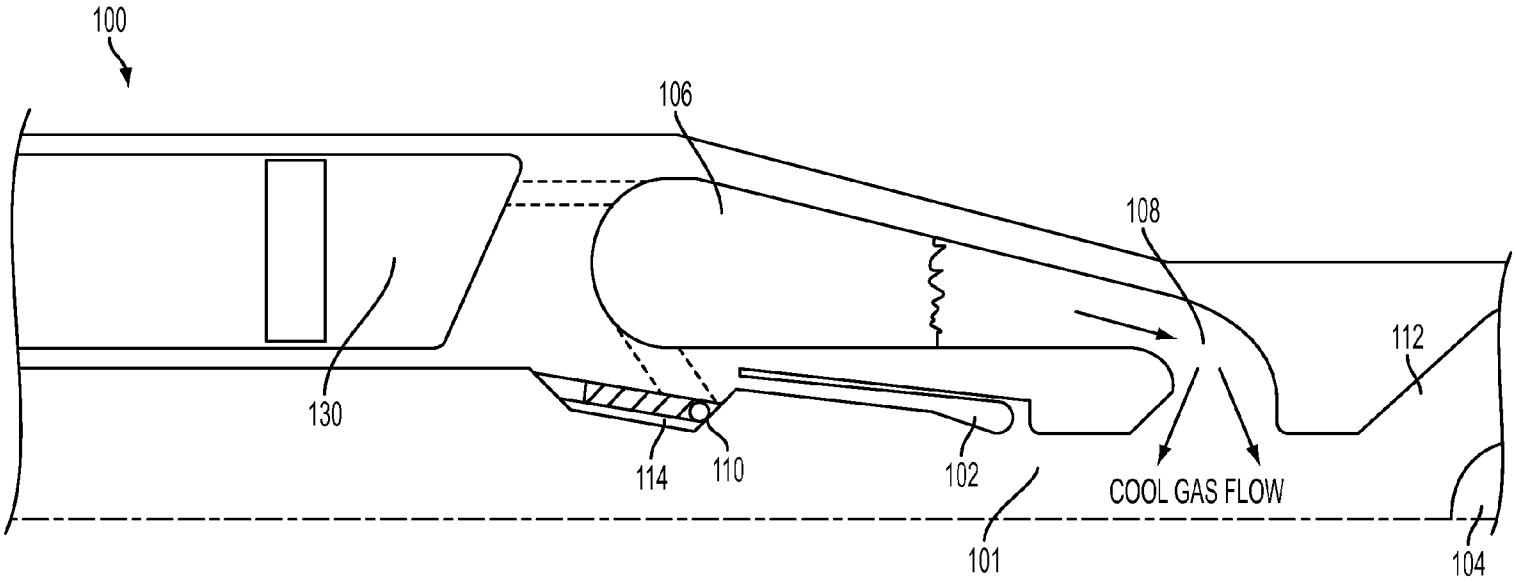
FIG. 3 illustrates the interrupter of FIG. 1 using an improved gas quenching means for extinguishing the arc.

As shown in FIG. 3, as the female contact 102 continues to move away from the male contact 104, the valves 114 return to their original position and the interrupter 100 behaves similarly to a prior art inhale/exhale interrupter as the quenching gas (represented by the arrows in FIG. 3) flows from the heating chamber via the channel 108 over the arc 116 and through the male-side exhaust 112 and the female-side exhaust 110, thereby extinguishing the arc and removing any particulate or debris caused by the arc.

As shown in FIGS. 1-3, the heating chamber 106 may be shaped so as to create a piston-like effect within the chamber, thereby using the force of the heated gas to push out the quenching gas as shown in FIG. 3. For example, the heating chamber 106 may have a teardrop shape that tapers narrower as the quenching gas flows toward the channel 108. It should be noted, however, that a teardrop shape of the heating chamber 106 is shown by way of example only.

Each valve 114 may be of various design and implementation and are shown as a pivoting valve for illustrative purposes only. For example, as shown in FIGS. 1-3, the valve 114 may be implemented as a floating ball valve in which the ball seats against toward the downstream side (at heating chamber 106) as the pressure builds up in the arcing chamber 101. Each valve 114 may include a tensioned spring configured to allow the valve's ball to move to an open position once the pressure in the female-side exhaust 110 reaches a certain level. In various embodiments the diameter of the ball valve's passageway from the arcing chamber 101 to the heating chamber 106 may be greater than the diameter of the female contact 102 so that the valve does not serve as a dominant restriction in the flow of gas. As the pressurized gas flows into the heating chamber 106, the floating ball valve may remain open until the pressure in the heating chamber forces the valve shut, or alternatively, until the pressure in the female-side exhaust 110 reaches a level below that which is required to open the floating ball valve. A valve implemented in this manner may not be dependent on the position of the nearest contact 102. Rather, no matter what the position of the contact 102, so long as the pressure in the arcing chamber 101 is higher than the pressure in the heating chamber 106, the valve(s) 114 will remain open. When the pressure in the heating chamber exceeds that of the arcing chamber, the valve(s) 114 will close.

Figure 4:
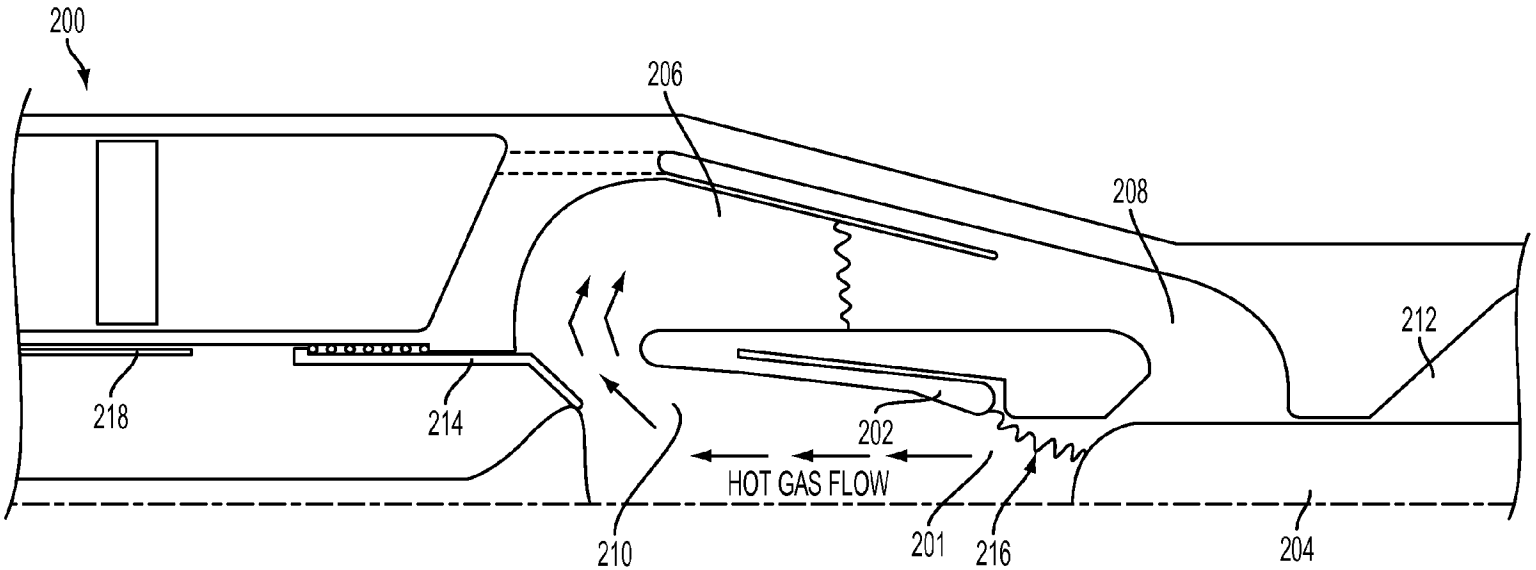
FIG. 4 illustrates a second circuit interrupter including a translating valve as an arc forms between contacts of the interrupter.
Figure 5:
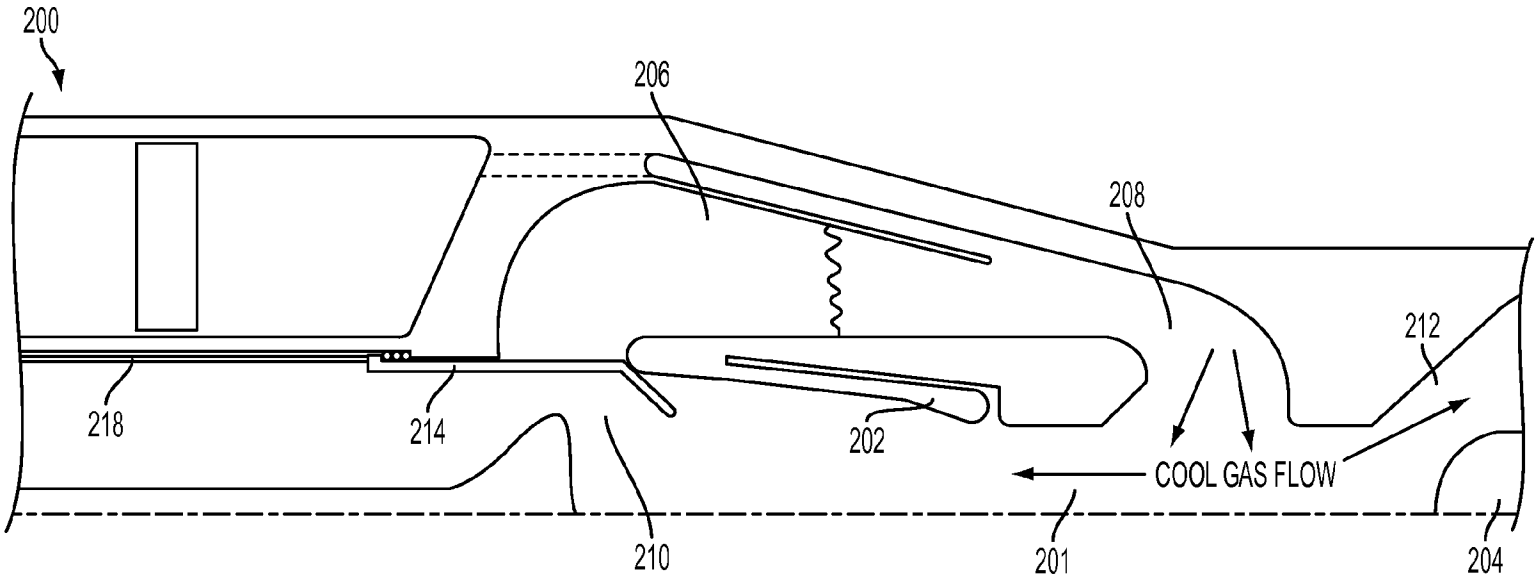
FIG. 5 illustrates the interrupter of FIG. 4 using an improved gas quenching means for extinguishing the arc.

In an alternative interrupter 200, as illustrated in FIGS. 4 and 5, each valve 214 may be a translating valve that has a direct or indirect mechanical connection with one or more of the contacts 202, 204 such that the valve moves open or closed as its corresponding contact moves. As shown in FIG. 4, when an arc 216 occurs the valve 214 may open a path between the arcing chamber 201 and heating chamber 206, and close off the path between arcing chamber 201 and a female-side exhaust path 210, for a portion of the interrupting stroke, such as approximately the first third of the stroke distance. As shown in FIG. 5, after the first portion of the stroke, the valve 214 may close off the heating chamber 206 and open the exhaust 210 so that gas from the arcing chamber 201 thereafter flows through a male-side exhaust 212 and the female-side exhaust 210, thereby extinguishing the arc and removing any particulate or debris caused by the arc. The translating valve may be biased with a spring or other mechanism so that it closes the path between the arcing chamber 201 and heating chamber 206 when the interrupter is either fully open (no current flowing, no arcing) or fully closed (current flowing)

It should be noted that a floating ball valve (as shown in FIGS. 1-3) and a translating valve (as shown in FIGS. 4 and 5) are shown by way of example only. Other valves may be used, such as a pivoting valve, a translating poppet valve, or a pintle valve.

It should be noted that in alternative embodiments a male contact may be configured to move away from female contact and the operation of the valve may be dependent instead on the position of the male contact. In yet another alternative, both contacts may be configured to move. Thus, the operation of the valve may be dependent on the position of one or both of the contacts.

When the interrupter operates and hot gas passes from the arcing chamber 101 through the valve(s) 114 into the heating chamber 106, the hot gas acts as a piston in the wider base portion of the heating chamber, thus pushing the heating chamber's quenching gas into the channel 108 to extinguish the arc 106. During operation the flow rate of gas from the arcing chamber into the heating chamber may be subsonic (i.e., less than mach 1), while the flow rate of quenching gas from the heating chamber 106 to the arcing chamber 101 may be supersonic (i.e., from mach 1 to about mach 5).

The arcing chamber 101, valve(s) 114, heating chamber 106, and integral or separate chamber 108 may be formed of any material that will withstand high temperatures and pressures, such as steel, copper or alloys of steel or copper. After operation, the hearing chamber 106 will be refilled with quenching gas for use in subsequent interrupting operations. Optionally, after a period of time after interruption during which the quenching gas cools in the arcing chamber 101, the quenching gas may be returned to the heating chamber.

Referring again to FIG. 1, in some embodiments a compression chamber 130 may hold additional quantities of gas, optionally in compressed form. The compression chamber 130 may be fluidly connected to the heating chamber 106 via a small channel to direct cool, pressurized gas into the heating chamber after an arcing event to help cool heating chamber 106. The gas in the compression chamber 130 may be air, quenching gas, or other material, optionally cooled below ambient temperature.

It should be noted that the position of the various interrupter components as shown above is shown by way of example only. For example, the geometry of the heating chamber 106 and channel 108 may be altered depending on the configuration of the exhaust pathways in the interrupter. Additionally, as discussed above, the configuration and movement of contacts 102 and 104 may vary depending on the design of the interrupter.

Were it not for the position of the valves 114 shown, in the interrupter, any pressurized gas generated by an arc between the male contact 104 and the female contact 102 would be dispersed in multiple directions. A portion of the gas would travel up the channel 108 to pressurize the quenching gas contained within the heating chamber 106, a portion of the gas would travel through a male-side exhaust 112, and a portion would travel through a female-side exhaust 110. Thus, much of the energy created by the are would be lost through the exhausts 110 and 112.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

The invention claimed is:

1. A gas-insulated circuit interrupter comprising:
an arcing chamber having an exhaust;
a first contact;
a second contact positioned within the arcing chamber and configured to alternatively connect to and disconnect from the first contact at an arcing area;
a heating chamber for accommodating a quenching gas;
a channel that fluidly connects to the heating chamber and the arcing area and that is positioned to direct quenching gas into the arcing area during a disconnection operation of the first and second contacts; and
a wall that separates the arcing area from the heating chamber;
a valve is positioned in the wall, and provides a path between the heating chamber and the arcing chamber and that is configured to:
maintain the path between the heating chamber and the arcing chamber as closed when the first contact and second contact are connected,
open the path when an arc is formed as the first contact and second contact disconnect during current-carrying operation and thus direct the quenching gas from the exhaust to the heating chamber, and
close the path when the arc is quenched.

2. The interrupter of claim 1, wherein the heating chamber comprises a teardrop shape.

3. The interrupter of claim 1, wherein the exhaust is configured so that gas may pass from the arcing area through a first exhaust path when the valve is closed.

4. The interrupter of claim 1, wherein the valve is further configured to open in response to a pressure increase in the arcing chamber.

5. The interrupter of claim 1, wherein the valve is configured to open in response to a mechanical operation of either the first contact or the second contact.

6. The interrupter of claim 3, wherein:
the first exhaust path is positioned proximate the second contact; and
the interrupter further comprises a second exhaust path positioned proximate the first contact.

7. The interrupter of claim 6, wherein the channel is further positioned to direct compressed quenching gas through the arcing area and into the first exhaust path and the second exhaust path.

8. The interrupter of claim 1, wherein the valve comprises a floating ball valve.

9. The interrupter of claim 1, wherein the valve comprises a translating valve.

10. The interrupter of claim 1, wherein the valve comprises at least one of a pivoting valve, a translating poppet valve, and a pintle valve.

11. A gas-insulated circuit interrupter comprising:
an arcing chamber;
a first contact;
a second contact positioned within the arcing chamber and configured to alternatively connect to and disconnect from the first contact at an arcing area;
a heating chamber for accommodating a quenching gas;
a channel that fluidly connects to the heating chamber and the arcing area and that is positioned to direct quenching gas into the arcing area during a disconnection operation of the first and second contacts; and
a wall that separates the arcing area from the heating chamber;
a valve is positioned in the wall, and provides a path between the heating chamber and the arcing chamber and that is configured to:
maintain the path between the heating chamber and the arcing chamber as closed when the first contact and second contact are connected,
open the path when an arc is formed as the first contact and second contact disconnect during current-carrying operation and thus redirect the quenching gas from the arcing chamber to the heating chamber, and
close the path when the arc is quenched; and
a first exhaust path that is configured so that gas may pass from the arcing area through the exhaust path when the valve is closed.

12. The interrupter of claim 11, wherein the heating chamber comprises a teardrop shape.

13. The interrupter of claim 11, wherein the valve is further configured to open in response to a pressure increase in the arcing chamber.

14. The interrupter of claim 11, wherein the valve is configured to open in response to a mechanical operation of either the first contact or the second contact.

15. The interrupter of claim 11, wherein:

the first exhaust path is positioned proximate the second contact; and the interrupter further comprises a second exhaust path positioned proximate the first contact.

16. The interrupter of claim 15, wherein the channel is positioned to direct compressed quenching gas through the arcing area and into the first exhaust path and the second exhaust path.

17. The interrupter of claim 11, wherein the valve comprises a floating ball valve, a translating valve, a pivoting valve, a translating poppet valve, or a pintle valve.

18. A gas-insulated circuit interrupter comprising:

an arcing chamber;

a first contact;

a second contact positioned within the arcing chamber and configured to alternatively connect to and disconnect from the first contact at an arcing area;

a heating chamber for accommodating a quenching gas;

a channel that fluidly connects to the heating chamber and the arcing area and that is positioned to direct quenching gas into the arcing area during a disconnection operation of the first and second contacts; and a wall that separates the arcing area from the heating chamber;

a valve is positioned in the wall, and provides a path between the heating chamber and the arcing chamber and that is configured to:

maintain the path between the heating chamber and the arcing chamber as closed when the first contact and second contact are connected, open the path when an arc is formed as the first contact and second contact disconnect during current-carrying operation and thus redirect the quenching gas from the arcing chamber to the heating chamber, and close the path when the arc is quenched;

a first exhaust path that is positioned proximate the second contact and configured so that gas may pass from the arcing area through the first exhaust path when the valve is closed; and a second exhaust path that is positioned proximate the first contact.

19. The interrupter of claim 18, wherein the valve is further configured to open in response to either or both of:

a pressure increase in the arcing chamber; and a mechanical operation of either the first contact or the second contact.

20. The interrupter of claim 18, wherein the channel is positioned to direct compressed quenching gas through the arcing area and into the first exhaust path and the second exhaust path.

* * * * *